US005832553A

United States Patent [19]

Merloni

[11] Patent Number: 5,832,553

[45] Date of Patent: Nov. 10, 1998

[54] WASHING PROCEDURE AND WASHING MACHINE FOR THE PERFORMANCE OF THE AFOREMENTIONED PROCEDURE

[75] Inventor: Antonio Merloni, Fabriano, Italy

[73] Assignee: Antonio Merloni S.p.A., Fabriano, Italy

[21] Appl. No.: 822,726

[22] Filed: Mar. 24, 1997

[51] Int. Cl.[6] ..... D06F 33/02

[52] U.S. Cl. ..... 8/159; 68/12.02; 68/12.22

[58] Field of Search ..... 8/159; 68/12.02, 68/12.03, 12.22, 58, 139, 15

[56] References Cited

U.S. PATENT DOCUMENTS

| | | | |
|---|---|---|---|
| 2,683,097 | 11/1954 | Chatelain | 68/12.22 |
| 2,985,177 | 5/1961 | Gilson | 68/12.22 |
| 4,794,661 | 1/1989 | Durazzani | 8/159 |
| 4,868,944 | 9/1989 | Ishino et al. | 8/159 |
| 4,916,768 | 4/1990 | Broadbent | 8/159 |
| 5,191,667 | 3/1993 | Roy et al. | 8/159 |
| 5,507,054 | 4/1996 | Blauert et al. | 8/158 |
| 5,560,061 | 10/1996 | Wentzlaff et al. | 8/159 |

FOREIGN PATENT DOCUMENTS

| | | | |
|---|---|---|---|
| 1460953 | 4/1969 | Germany | 68/12.22 |
| 2112285 | 12/1971 | Germany | 68/12.22 |

OTHER PUBLICATIONS

Eurpoean Patent Office 326,800, Aug. 1989.

*Primary Examiner*—Frankie L. Stinson
*Attorney, Agent, or Firm*—Richard M. Goldberg

[57] ABSTRACT

A washing procedure with a washing machine composed of alternate agitation (A) and agitation stoppage (S) phases for the laundry in a washing mixture (M) and a simultaneous phase, in which the washing mixture (M) is heated. Pursuant to the invention, the phases comprising the agitation stoppage (S), scheduled according to an established washing cycle, are either extended or reduced (T2, T2'), according to the extension or reduction of the heating time for the washing mixture (M) caused by variations in the electric current, while the number of agitation (A) and agitation stoppage (S) phases and the duration (T1) of the agitation phases (A) remain constant. For the execution of this procedure, the washing machine has programming devices (12) for the washing cycle, devices to measure the electric current and processors to measure variations in the duration of the agitation stoppage phases according to variations in the electric current measured against a standard nominal value (14, 15, 16).

10 Claims, 2 Drawing Sheets

WASHING PROCEDURE AND WASHING MACHINE FOR THE PERFORMANCE OF THE AFOREMENTIONED PROCEDURE

A washing machine with a washing machine composed of alternate agitation and agitation stoppage phases for the laundry in the washing mixture and a simultaneous phase, in which the washing mixture is heated.

At the present time, in washing machines, and particularly those intended for household use, the washing effect is achieved by agitating and mixing the laundry in the water and detergent mixture. In addition to the agitation phases, there are also phases, in which the washing mixture is heated in order to increase the effectiveness of the washing action. Washing programs generally offer various options, which are illustrated in FIGS. 1–3. The agitation phases are alternated at preset intervals with agitation stoppage phases; the relative duration of the agitation and agitation stoppage phases varies according to the laundry cycle: normal, heavy or delicate, and these alternate phases involving agitation and agitation stoppage are repeated until a maximum temperature, which is preset or which can be established, is reached. This is followed by rinse and drain phases and possibly by phases involving the drying of the laundry (see FIGS. 1 and 2).

The differences in the washing programs illustrated in the charts in FIGS. 1 and 2 consist in the fact that, in the program shown in FIG. 2, the alternation of the agitation phases and the agitation stoppages continues for an established time that can be preset, before beginning the rinse, drain, and possibly the drying cycles.

In these well-known washing programs and in any other known type of washing program, the duration of the washing cycle is linked in time to the duration of the period needed to heat the water and detergent mixture. Thus, in these washing procedures, differences in the electric current cause a variation in the times needed to heat the water and detergent mixture. At the same time, because the agitation and agitation stoppage times are constant, variations in the electric current cause an increase or a reduction of the washing effect. In fact, when the current is higher than projected, the washing time is shortened and thus the washing action is reduced. When, on the other hand, the current is lower than projected, the heating time is extended and the washing action is increased. In addition, the drive motor which, both for reasons of cost and due to its size and weight, is specially designed for the function that it is to perform, exceeds the established running time and runs the risk of breakdown due to overheating.

Variations in electrical current, particularly in domestic use, are relatively common and their occurrence and impact varies from area to area according to the condition of the power plants, the number and type of consumers, and the time period.

For this reason, the invention has the goal of establishing a washing procedure of the type described at the beginning of this document, which, as a result of simple devices which are safe and economical, allows it to take account of variations in electrical current and obviate the inconveniences noted above.

The invention achieves the aforementioned goals through a washing procedure of the type described at the beginning of this document, in which the agitation stoppage cycles in an established washing program are extended or reduced according to the extension or reduction of the time needed to heat the water and detergent mixture caused by variations in electrical current, while the number of agitation and stoppage cycles and the duration of the agitation cycle remain constant.

The procedure established in the invention offers the advantage of having a phase that measures the electrical current, which may be done either continuously or at regular intervals during the washing cycle, a phase that involves the determination of the positive or negative variation of the effective current against a nominal value, which may be preset for the electric current, the determination of the positive or negative variation of the heating times, and the increase or reduction of the duration of the individual stoppages, for which the total increase or reduction of all the stoppage phases corresponds to variations in the heating time.

The invention also involves a washing machine for the execution of this method, including a device that programs the washing cycle, especially to turn on and shut off the drive motor, devices that supply electric current to the heating coils, which are powered electrically, other devices that measure the electric current and devices that control the extension or reduction of the stoppage phases according to variations in the effective electric current measured against an established nominal value.

The devices that measure the current and the computer processors used for the extension and reduction of the agitation stoppage phases may include devices to compare the effective current against a nominal reference value, memory in which a certain program is stored, a table or function for example, that correlates variations in current with variations in the duration of the agitation stoppage phases, and devices to program automatic adjustments according to variations in the agitation stoppage phases. All these functions can be performed simply by a specially programmed microprocessor, which is linked to programs in the washing machine.

Other parts of the invention are the subject of the claims.

The features of the invention and the advantages that it offers are detailed in the following description of a non-limiting example of its operation illustrated in the attached diagrams:

Figure 1:
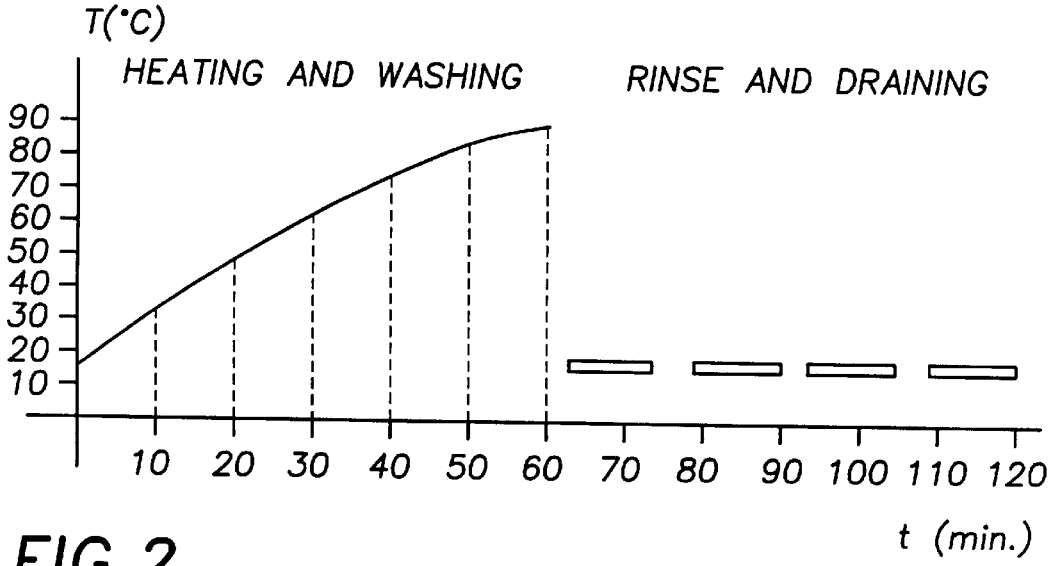
FIGS. 1 and 2 illustrate two typical washing systems for washing machines.
Figure 2:
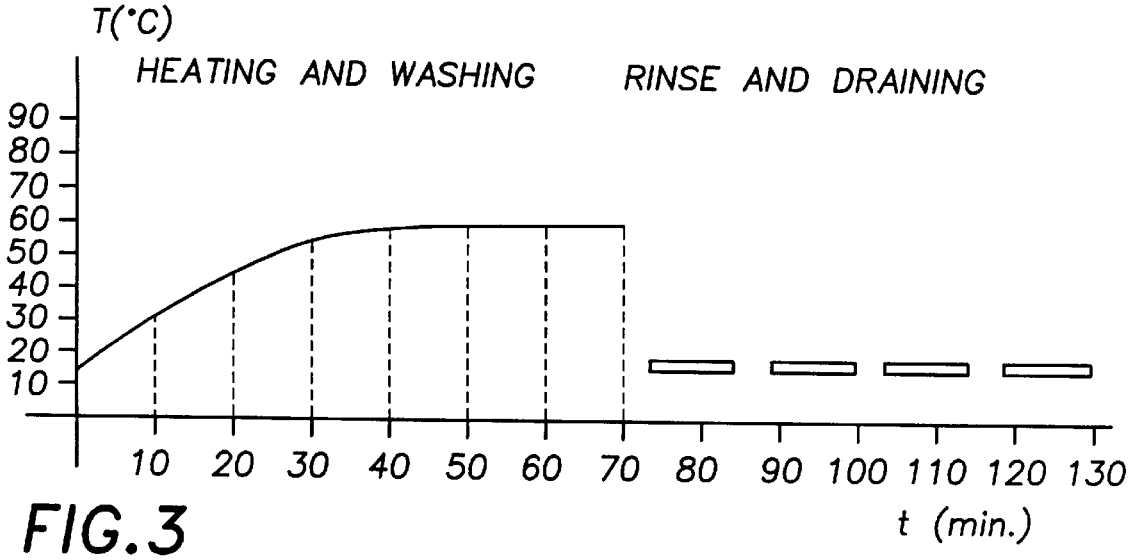
Figure 3:
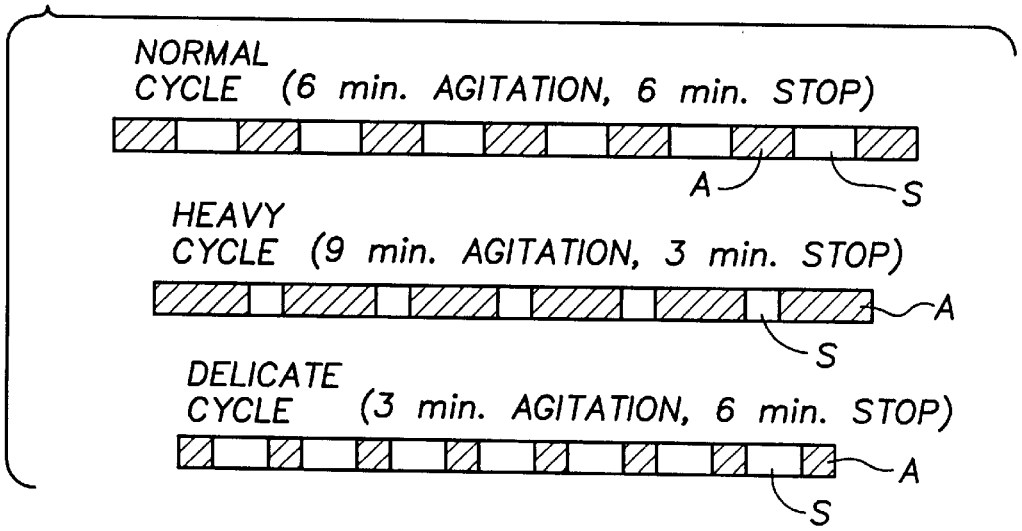
FIG. 3 illustrates the different washing cycles that can be used in the diagrams presented in FIGS. 1 and 2.

FIGS. 1, 2 and 3 illustrate two washing systems generally used in washing machines. In FIG. 1, while the washing mixture is heated progressively until it reaches an established temperature, the agitation phase and the agitation stoppage phase are alternated at preset times as indicated in the three different cycles, that is, normal, heavy, and delicate, as represented in FIG. 3. In this Figure, the agitation phases are illustrated with slanted lines, indicted by the letter A, while the agitation stoppage phases are illustrated by blank spaces and indicated by the letter S. When the maximum established heating temperature is reached, the washing cycle ends and the rinse and drain cycles begin. The washing system presented in FIG. 2 differs from the system in FIG. 1 in that the agitation and the agitation stoppage phases of the washing cycle are extended for a certain period of time even when the washing mixture has reached the maximum established heating temperature, before beginning the rinse and drain cycles.

In both washing systems, the duration of the washing cycle is always linked to the time necessary to heat the washing mixture to the established temperature; thus, the positive or negative variation in the heating time directly affects the duration of the washing cycle as a positive or negative variation. Hence, the washing effect of an established cycle may be falsified, in that the cycle itself may be reduced or extended excessively.

Figure 4:
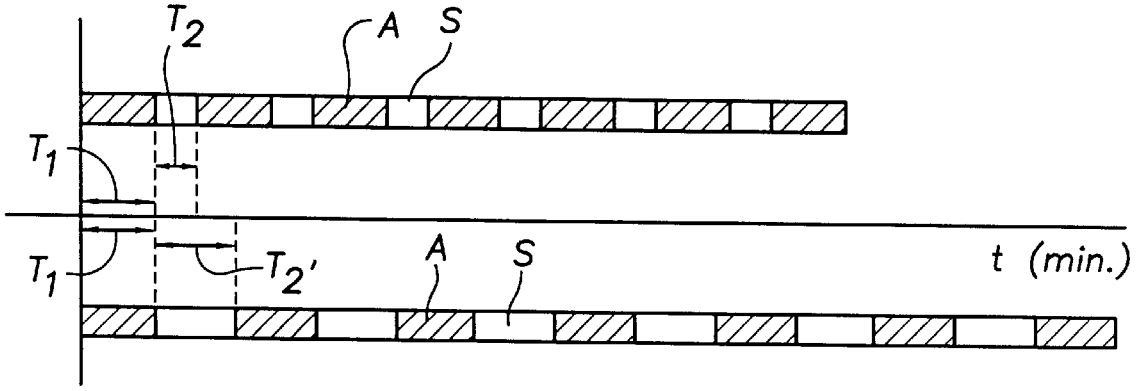
FIG. 4 illustrates the washing cycles established in the invention.

In respect to FIG. 4, the invention compensates for variations in the heating time by extending or reducing the agitation stoppage phases in the washing cycle and maintaining the number and duration of agitation phases constant. The total variation in the heating time is divided among the individual agitation stoppage phases, while the washing cycle always has the established number of agitation phases with their established duration; thus, the washing effect and the treatment of the laundry is constant even in the event of variations in heating times.

Figure 5:
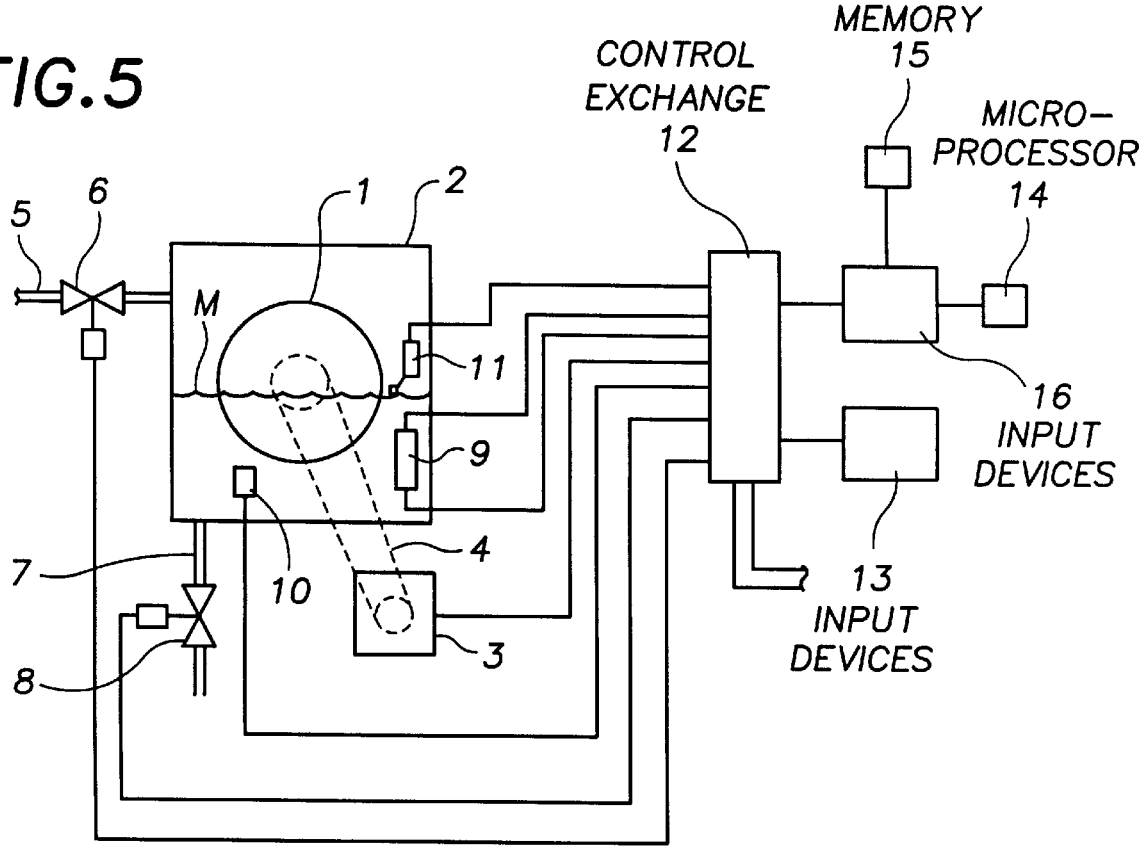
FIG. 5 illustrates a block diagram of a washing machine for the execution of the method established in the invention.

FIG. 5 presents a washing machine that is capable of executing a washing procedure according to the invention and corresponding to the system introduced in FIG. 4, with a rotation drum 1 in a cup 2 for the washing mixture M. The drum 1 has holes for the entrance of the washing mixture and rotates as a result of an electrical motor 3, equipped with a transmission 4. The cup 2 for the washing mixture M has a feed spout 5 for the water or the washing mixture, with an electric intercept valve 6, a drainage spout 7 for the washing mixture M and the rinse water, which also has an electric intercept valve 8; a device for heating the washing mixture, and generally also a heating coil 9; at least one sensor 10 to measure the temperature of the washing mixture M in the cup 2, and at least one sensor 11 to measure the level of the washing mixture M in the cup 2.

The aforementioned devices are linked to a control exchange, which is designed to allow the execution of preset washing programs. The control exchange 12 may be electrical or electronic. It is linked to the output from the sensors 10 that measure the temperature and the washing mixture level and the current lines from the motor 3, the heating coil 9 and the electric valves 6 and 8. The control exchange 12 is powered by network current and is equipped with devices to input and/or choose the programs and display of the options to choose or preset. All these devices are illustrated under number 13 in FIG. 5.

In order to keep tack of variations in the electric current, which cause the extension of reduction of the time needed to heat the washing mixture M, the control exchange 12, which serves as the programming device, is equipped with other devices 14 that measure the network current.

These devices may be of any type. Preferably, they are electronic, like the control exchange or programming device 12. In particular, these measuring devices are composed of a microprocessor, which compares the variation of the electric current against a preset nominal value, according to which the washing programs are calibrated.

The microprocessor 14 may have a memory 15, which stores the processing program, and a program to transform the variations in heating time to variations in the agitation stoppage phases in the washing cycle. This occurs as a result of a specific algorithm, or on the basis of a table that is determined empirically and stored in the memory 15 of the microprocessor.

In addition, the microprocessor 14 may have devices 16 used to input, edit, update and/or display the protocols for correlations between variations in the heating time and variations in the duration of the stoppage phase or the preset nominal value of the current.

The microprocessor 14 linked to the programming device 12, modifies the command parameters in order to obtain the variations in the duration of the agitation stoppage phases determined according to variations in the heating times, that is, according to the electric current.

The washing procedure is presented in detail in FIG. 4, which compares two washing cycles performed with a different electric current and thus with different heating times. Similarly, in FIG. 3, the agitation phases A are illustrated with slanted lines, while the stoppage phases are illustrated by blank spaces. The duration T1 of the agitation phases is identical for the two examples, where the duration T2 of the agitation stoppages in the cycle on the top of the chart is less than the duration T2' of the stoppages in the cycle in the lower part of the chart. In the cycle presented in the top of the chart the effective current, particularly in the coil, is greater than the nominal value, that is the projected value; thus, the total heating time is less than the time established for the process, and the reduction of the heating time is compensated by the corresponding reduction in all the agitation stoppage phases; in this manner, the number of alternate agitation and agitation stoppage phases and the duration of the agitation phases remain constant.

In the cycle presented in the lower part of the diagram, the electric current is less than the current presented in the top part of the diagram. In this case, the extension of the heating time is compensated a corresponding extension of the duration of the agitation stoppage phases, without varying the number of agitation and agitation stoppage phases and the duration of the agitation phases.

Naturally, the invention is not limited to the forms of execution described and illustrated herein; it may be modified, principally in terms of construction. Thus, for example, the programming device and the microprocessor, used to measure the electric current, are not necessarily limited to the forms of execution illustrated. Instead, they may also be composed of mechanical, electrical or similar devices or other types of electronic circuits, without abandoning the principles described above and detailed in the claims.

What is claimed is:

1. A washing method with a washing machine comprised of alternate agitation and agitation stoppage phases for laundry in a washing mixture of water and detergent, and a simultaneous phase in which the washing mixture is heated, comprising the steps of:

extending or reducing a duration of the agitation stoppage phases, established according to a preset washing program, in correlation to an extension or reduction of time needed to heat the mixture of water and detergent caused by variations in the electric current, and maintaining the number of agitation and agitation stoppage phases and a duration of the agitation phases constant.

2. The method according to claim 1, further comprising the following steps:

measuring the electric current, which may be performed one of continuously and at regular intervals, during a washing cycle, a first step of determining positive or negative variations of the electric current against a nominal value which may be preset for the electric current, a second step of determining positive or negative variations in heating times in response to said first step of determining, and a third step of determining an increase or reduction in the duration of individual agitation stoppage phases in such a manner that a total of the increase or reduction of the agitation stoppage phases corresponds to variations in the heating times determined by said second step of determining.

3. A washing machine for execution of the method according to claim 2, comprised of:

a drive motor for driving the washing machine, a programming device for determining the washing cycle, including turning on and shutting off of the drive motor, a measuring device for measuring electric current, a heating coil connected to the measuring device, and a processor that controls the expansion or reduction of the agitation stoppage phases in correlation to variations in the electric current measured against a preset nominal value of electric current.

4. The washing machine of claim 3, further comprising a memory which stores at least one of (a) a program, (b) table and (c) function that correlates variations in current and variations of the duration of the agitation stoppage phases, and said processor includes a device to program automatic adjustments according to variations in the agitation stoppage phases.

5. The washing machine of claim 4, wherein at least one of (a) the programming device, (b) the measuring device and (c) the processor is comprised of a specially programmed microprocessor.

6. The washing machine of claim 3, wherein at least one of (a) the programming device, (b) the measuring device and (c) the processor is comprised of a specially programmed microprocessor.

7. A washing machine for execution of the method according to claim 1, comprised of:

a drive motor for driving the washing machine, a programming device for determining a washing cycle, including turning on and shutting off of the drive motor, a measuring device for measuring electric current, a heating coil connected to the measuring device, and a processor that controls the expansion or reduction of the agitation stoppage phases in correlation to variations in the electric current measured against a preset nominal value of electric current.

8. The washing machine of claim 7, further comprising a memory which stores at least one of (a) a program, (b) table and (c) function that correlates variations in current and variations of the duration of the agitation stoppage phases, and said processor includes a device to program automatic adjustments according to variations in the agitation stoppage phases.

9. The washing machine of claim 8, wherein at least one of (a) the programming device, (b) the measuring device and (c) the processor is comprised of a specially programmed microprocessor.

10. The washing machine of claim 7, wherein at least one of (a) the programming device, (b) the measuring device and (c) the processor is comprised of a specially programmed microprocessor.

* * * * *